US009763553B2

(12) United States Patent
Kutto et al.

(10) Patent No.: US 9,763,553 B2
(45) Date of Patent: Sep. 19, 2017

(54) DOOR ASSEMBLY FOR A DISHWASHER

(71) Applicant: WHIRLPOOL CORPORATION, Benton Harbor, MI (US)

(72) Inventors: Kevin T. Kutto, Pune (IN); Frederick A. Millett, Grand Haven, MI (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/287,064

(22) Filed: Oct. 6, 2016

(65) Prior Publication Data

US 2017/0020361 A1 Jan. 26, 2017

Related U.S. Application Data

(63) Continuation of application No. 14/134,380, filed on Dec. 19, 2013.

(51) Int. Cl.
*A47B 77/06* (2006.01)
*A47L 15/42* (2006.01)

(52) U.S. Cl.
CPC ..... *A47L 15/4265* (2013.01); *A47L 15/4257* (2013.01); *A47L 15/4263* (2013.01)

(58) Field of Classification Search
CPC ..... E05Y 2900/20; A47F 3/0434
USPC ..... 134/200; 312/138.1, 228, 326–328; 49/70, 501; 428/34; 52/786.1, 786.13
See application file for complete search history.

(56) References Cited

U.S. PATENT DOCUMENTS

| | | | | |
|---|---|---|---|---|
| 2,670,507 | A * | 3/1954 | Daitch | E06B 3/28 52/202 |
| 3,566,539 | A | 3/1971 | Ridgley | |
| 3,717,138 | A | 2/1973 | Upp | |
| 4,084,361 | A | 4/1978 | Aspaas | |
| 4,309,845 | A | 1/1982 | Schmidt | |
| 4,328,644 | A | 5/1982 | Scott et al. | |
| 4,606,324 | A | 8/1986 | Katona | |
| 4,856,243 | A | 8/1989 | Ault et al. | |
| 4,920,718 | A | 5/1990 | Artwick et al. | |
| 5,038,537 | A | 8/1991 | Frambach | |
| 5,546,714 | A | 8/1996 | Kenkel | |
| 6,135,130 | A | 10/2000 | Martineau | |
| 6,561,180 | B1 | 5/2003 | Austin et al. | |
| 6,766,596 | B1 | 7/2004 | Bienick et al. | |

(Continued)

FOREIGN PATENT DOCUMENTS

| | | | |
|---|---|---|---|
| DE | 1926825 | U | 11/1965 |
| EP | 2596736 | A1 | 5/2013 |

(Continued)

OTHER PUBLICATIONS

European Search Report for Corresponding EP14193302.8, Jan. 26, 2015.

*Primary Examiner* — Matthew Ing
(74) *Attorney, Agent, or Firm* — McGarry Bair PC

(57) ABSTRACT

A dishwasher includes a treating chamber for receiving dishes for treatment according to a cycle of operation and a door assembly selectively moveable to close an access opening to the treating chamber, the door assembly having an interior door panel, an exterior door panel, a window assembly and a window assembly support frame provided on the interior door panel to support the window assembly.

19 Claims, 12 Drawing Sheets

(56) References Cited

U.S. PATENT DOCUMENTS

| | | | |
|---|---|---|---|
| 8,523,300 | B2 | 9/2013 | Najera Bernal et al. |
| 9,022,091 | B2 | 5/2015 | Shives |
| 2005/0211278 | A1 | 9/2005 | Favaro et al. |
| 2012/0315409 | A1 | 12/2012 | Jones |

FOREIGN PATENT DOCUMENTS

| | | | |
|---|---|---|---|
| JP | 7163503 | A | 6/1995 |
| JP | 10179490 | A | 7/1998 |
| JP | 11346976 | A | 12/1999 |
| JP | 1999346976 | A | 12/1999 |
| JP | 2005342297 | A | 12/2005 |
| JP | 2005342383 | A | 12/2005 |
| KR | 100975771 | B1 | 8/2010 |

* cited by examiner

DOOR ASSEMBLY FOR A DISHWASHER

CROSS-REFERENCE TO RELATED APPLICATIONS

This application is a continuation of U.S. application Ser. No. 14/134,380, filed Dec. 19, 2013, now U.S. Pat. No. 9,538,900, issued on Jan. 10, 2017, which is incorporated herein by reference in its entirety.

BACKGROUND

A conventional automated dishwasher includes either a hinged or sliding door that selectively provides access to a treating chamber in which dishes are placed for treatment according to an automatic cycle of operation. Some doors may be provided with a window through which the treating chamber may be visible from an exterior of the dishwasher. The window provides an additional component in the dishwasher which must be provided within the dishwasher in such a manner as to minimize the leakage of fluid from the treating chamber to other parts of the dishwasher or to the exterior of the dishwasher.

BRIEF SUMMARY

An embodiment of the invention relates to a dishwasher comprising a treating chamber for receiving dishes for treatment according to a cycle of operation and a door assembly selectively moveable to close an access opening to the treating chamber, the door assembly comprising an interior door panel, an exterior door panel, a window assembly and a window assembly support frame provided on the interior door panel to support the window assembly.

DETAILED DESCRIPTION

Figure 1:
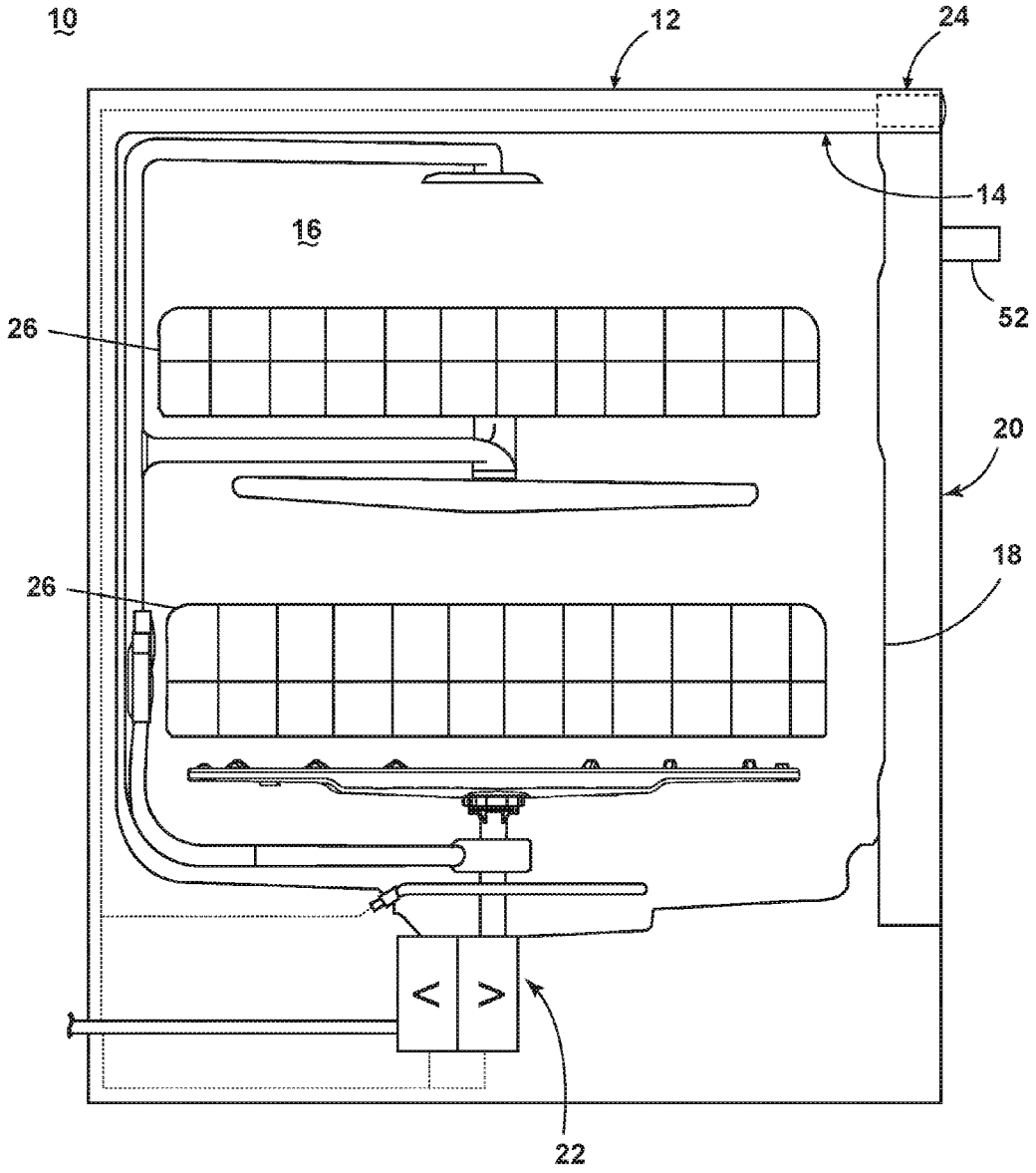
FIG. 1 is a schematic, cross-sectional view of a dishwasher according to an embodiment of the invention.

FIG. 1 is a schematic illustration of a dishwasher 10 that shares many features of a conventional automated dishwasher, which will not be described in detail herein except as necessary for a complete understanding of the invention. The dishwasher 10 may include a chassis 12 defining an interior of the dishwasher 10 and may include a frame, with or without panels mounted to the frame. A tub 14 may be provided within the chassis 12, and may at least partially define a treating chamber 16 for treating dishes according to a cycle of operation and further include an open face 18 defining an access opening to the treating chamber 16.

A door assembly 20 may be movably mounted to the dishwasher 10 for movement between opened and closed positions to selectively open and close the open face 18 of the tub 14. Thus, the door assembly 20 provides accessibility to the treating chamber 16 for the loading and unloading of dishes or other washable items. When the door assembly 20 is closed, user access to the treating chamber 16 may be prevented, whereas user access to the treating chamber 16 may be permitted when the door assembly 20 is open. The door assembly 20 may be hingedly connected with the chassis 12 or slidingly attached to a drawer slide system to selectively provide access to the treating chamber 16.

Additional features, such as a liquid supply and circulation system 22, including one or more liquid supply and drain conduits, sprayers and/or pumps, a control system 24 including one or more controllers and a user interface, one or more dish racks 26, and any other alternative or additional features used in a conventional automatic dishwasher may also be provided in the dishwasher 10 without deviating from the scope of the invention.

Figure 3:
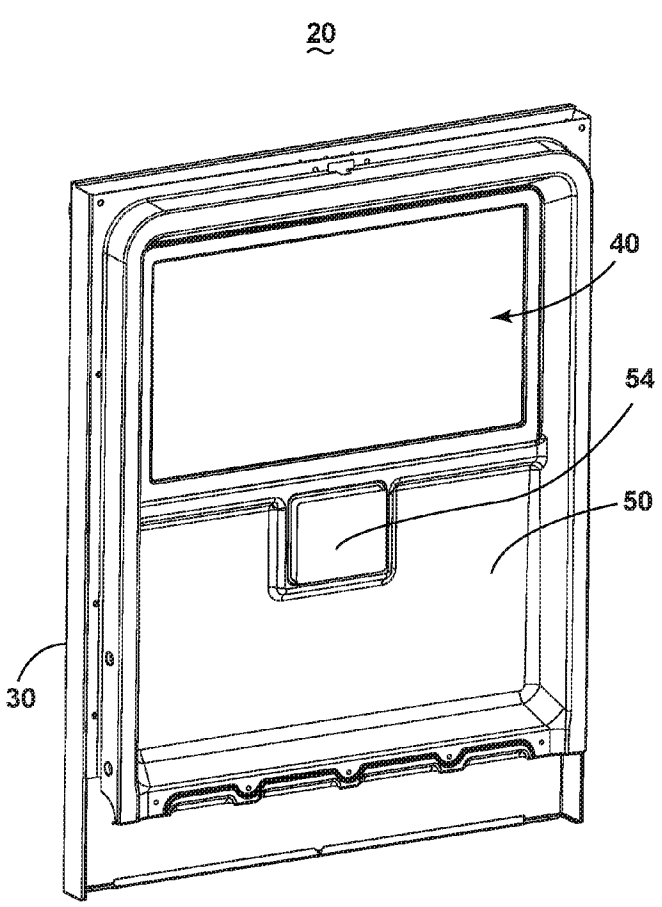
FIG. 3 is a rear perspective view of a door assembly for a dishwasher according to an embodiment of the invention.
Figure 2:
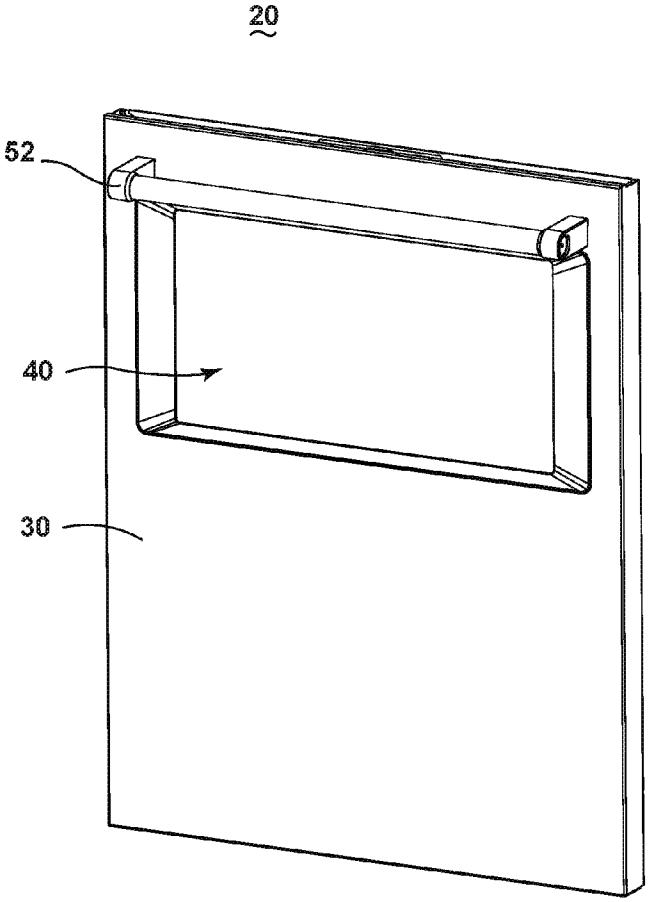
FIG. 2 is a front perspective view of a door assembly for a dishwasher according to an embodiment of the invention.

Referring now to FIGS. 2 and 3, the door assembly 20 may include an exterior door panel 30, a window assembly 40, and an interior door panel 50 which faces the treating chamber 16 of the dishwasher 10 when the door assembly 20 is in the closed position. The exterior door panel 30 may be coupled with the interior door panel 50 using any suitable mechanical and/or non-mechanical fasteners, non-limiting examples of which include screws, pins, clips, welds and adhesives. The door assembly 20 may include additional features, such as a handle or grip 52 or a dispenser 54, the details of which are not germane to the embodiments of the invention. The window assembly 40 may provide a user with a view of at least a portion of the treating chamber 16 from an exterior of the dishwasher 10.

Figure 4:
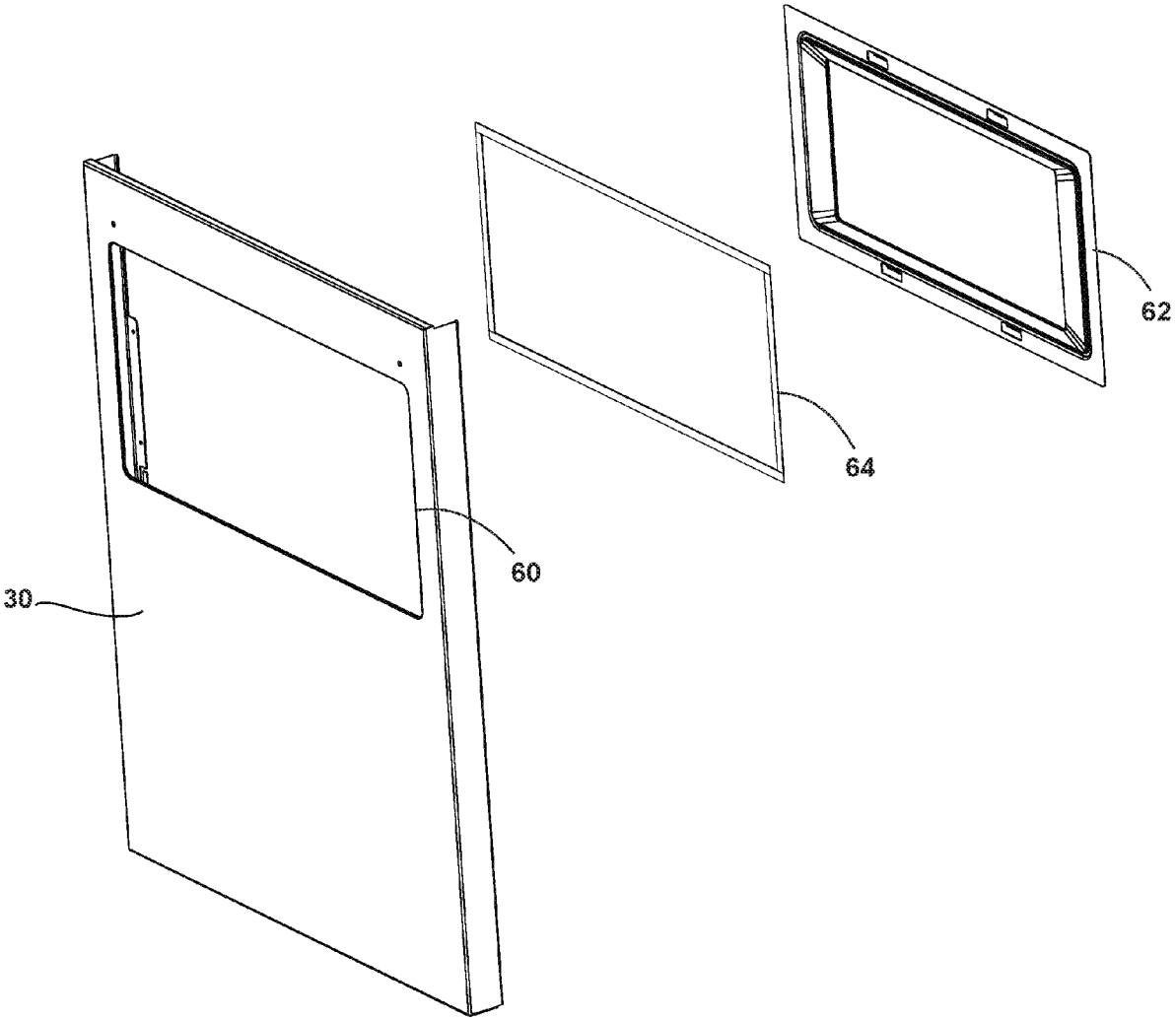
FIG. 4 is an exploded view of the door assembly of FIG. 2.
Figure 5:
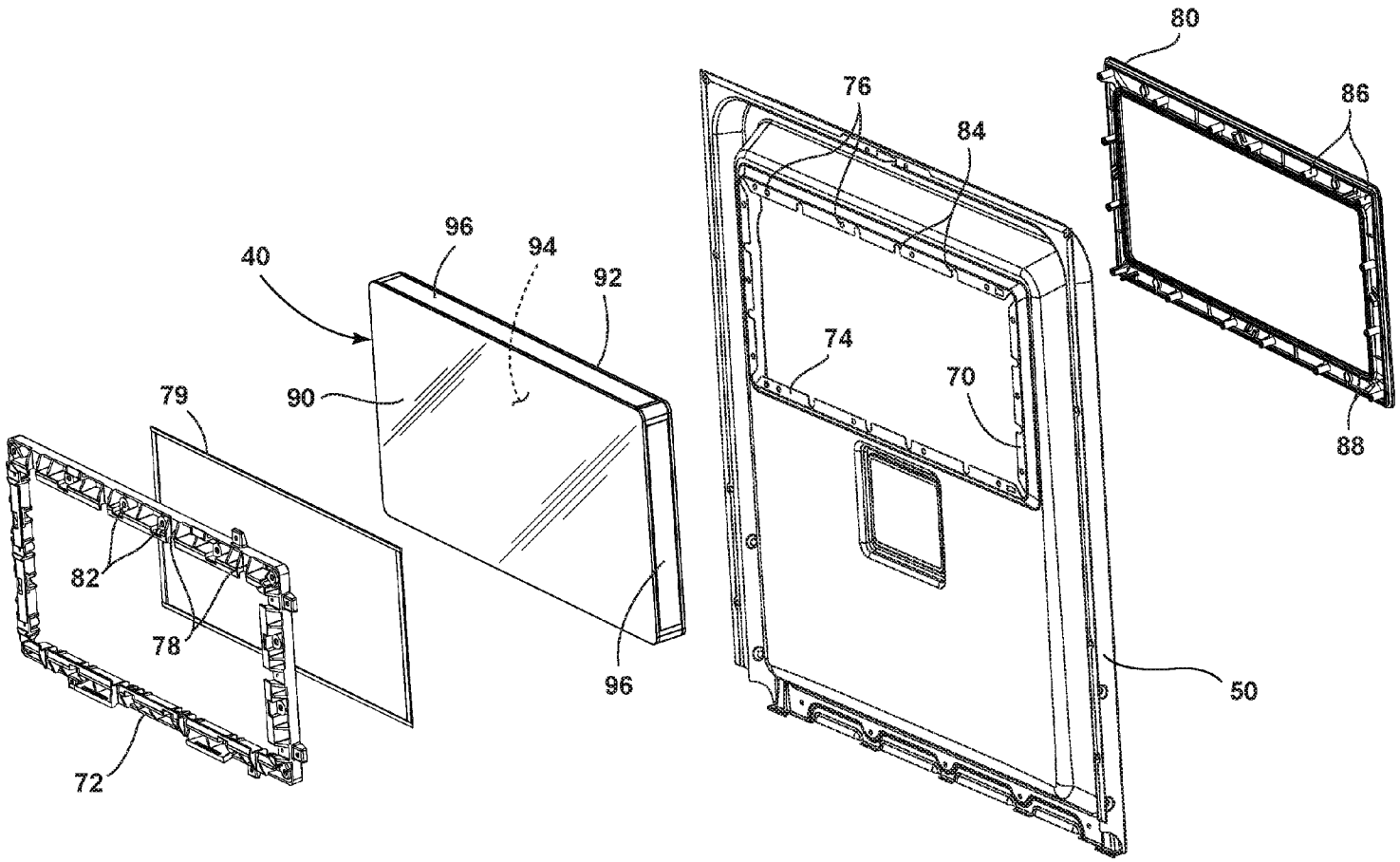
FIG. 5 is an exploded view of the door assembly of FIG. 3.

FIGS. 4 and 5 illustrate exploded views of a portion of the door assembly 20. As illustrated in FIG. 4, the exterior door panel 30 includes an exterior window opening 60. An exterior trim bezel 62 may be coupled with an inner face of the exterior door panel 30 in general alignment with the exterior window opening 60 using any suitable mechanical or non-mechanical fasteners, non-limiting examples of which include screws, clips, welds and/or adhesives. Alternatively, or additionally, the exterior trim bezel 62 may be coupled with the exterior door panel by an adhesive 64, such as a low density PVC closed cell foam tape, for example.

Referring now to FIG. 5, the interior door panel 50 includes an interior window opening 70. A window assembly support frame 72 may be coupled with the interior door panel 50 to support the window assembly 40 in at least partial alignment with the interior window opening 70. As illustrated in FIG. 5, the interior door panel 50 may include a mounting flange 74 defining the interior window opening 70 having a first set of mounting flange apertures 76. The window assembly support frame 72 may be mounted to the interior door panel 50 by fasteners (not shown) inserted through the first set of mounting flange apertures 76 and into a first set of aligned apertures 78 in the window assembly support frame 72. The window assembly support frame 72 may also optionally include a support 79 in the form of a foam tape, for example, to support and cushion the window assembly 40 within the window assembly support frame 72.

The door assembly 20 may also include an interior trim bezel 80 which may be mounted to the interior door panel 50 by a plurality of fasteners (not shown) inserted through a second set of apertures 82 in the window assembly support frame 72 and a second set of apertures 84 in the mounting flange 74 and into a set of aligned bezel apertures 86. The interior trim bezel 80 may optionally include a seal 88, such as a gasket, foam sealant, or silicone, for example, to provide a fluid-tight seal between the window assembly 40 and the interior door panel 50. In one example, the seal 88 may be an overmolded gasket made from an elastomeric material, such as a polyolefin-based thermoplastic material (e.g. Santoprene™, available from ExxonMobil Chemical) or an ethylene propylene diene-based rubber (e.g. EPDM). The use of overmolding may decrease the likelihood of gasket misalignment during assembly.

Figure 6:
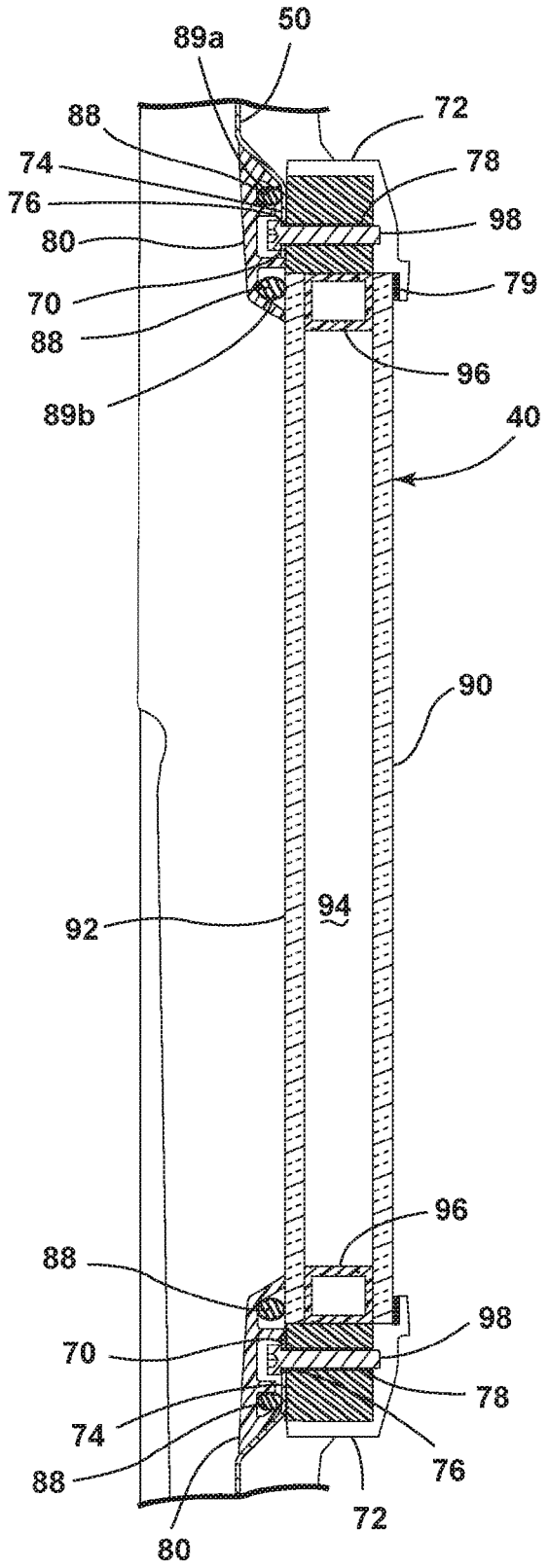
FIG. 6 is a cross-sectional view of a door assembly according to an embodiment of the invention.

The seal 88 may be provided to fluidly seal the window assembly 40 and/or window assembly support frame 72 with the interior door panel 50 to inhibit the flow of fluid between the window assembly 40 and/or window assembly support frame 72 and the interior door panel 50 to minimize or prevent leakage of fluid into a space behind the interior door panel 50 and between the exterior door panel 30. In the exemplary embodiment illustrated in FIG. 6, the seal 88 may include a first portion 89*a* providing a fluid seal between the interior trim bezel 80 and the mounting flange 74 and a second portion 89*b* providing a fluid seal between the trim bezel 80 and the window assembly 40 to minimize leakage of fluid at the interior window opening 70. While FIG. 6 illustrates the second seal portion 89*b* as forming a seal against the window assembly 40, the seal may alternatively be formed at the window assembly support frame 72 or at the interface of the window assembly 40 and window assembly support frame 72, depending on the configuration of the window assembly support frame 72, window assembly 40, interior window opening 70 and interior trim bezel 80. The seal 88 may be a single seal having multiple portions, such as first and second portions 89*a*, 89*b* or multiple individual seals. Alternatively, only one seal or portion of a seal, such as 89*a* or 89*b*, may be used.

The window assembly support frame 72 and interior door panel 50 may also include one or more sets of alignment keys to facilitate coupling the window assembly support frame 72 with the interior door panel 50. Similarly, the interior door panel 50 and interior trim bezel 80 may include one or more sets of alignment keys to facilitate coupling the interior trim bezel 80 with the interior door panel 50.

Still referring to FIG. 5, the window assembly 40 may include a first or exterior window pane 90 and a second or interior window pane 92. The first and second window panes 90, 92 may be made from a material that is at least partially transparent such that light may travel through the window assembly 40 from the treating chamber 16 to an exterior of the dishwasher 10 such that a user may view at least a portion of the treating chamber 16 from the exterior of the dishwasher. The first and second window panes 90, 92 may be made from glass or an at least partially transparent polymeric material, such as poly(methyl methacrylate) (PMMA). In another example, the first and/or second window panes 90, 92 may be made from materials having light transmission properties that change when voltage, light or heat is applied. Non-limiting examples of such materials include electrochromic, photochromic, and thermochromic materials. In one example, the first and/or second window panels 90, 92 may be made from a polymer dispersed liquid crystal device in which the light transmission properties may be changed by modifying the voltage applied to the material. The first and second window panes 90, 92 may be spaced from one another to define a sealed chamber 94. In one example, the window assembly 40 may include one or more spacer elements 96 provided between the first and second window panes 90, 92 to define the sealed chamber 94. The spacer elements 96 may extend about and be coextensive with the peripheral of the window panes 90, 92. Thus, the spacer elements 96 may provide a support functionality as well as a spacing functionality for the window assembly 40. The first and second window panes 90, 92 may be sealed with the spacer elements 96 by an adhesive or a weld, for example.

The first and second window panes 90, 92 and/or the sealed chamber 94 may be configured to attenuate the transmission of sound vibrations from within the treating chamber 16 to the exterior of the dishwasher 10. In general, sound vibrations or waves from inside the treating chamber 16 will cause the second panel 92 to vibrate and the vibrations are transferred across the sealed chamber 94 to the first pane 90, causing the first pane 90 to vibrate and possibly produce undesirable sounds that are audible to a user. In one example, the thickness of either or both the first and second window panes 90, 92 may be selected to provide the desired amount of sound vibration attenuation to decrease the sound heard by the user. Alternatively, or additionally, the distance between the first and second window panes 90, 92 may be selected to provide the desired amount of sound vibration attenuation. In another example, either or both of the first and second window panes 90, 92 may be made from laminated glass to attenuate sound vibration. Laminated glass, also sometimes referred to as safety glass, is made from layers of glass that include an interlayer, such as polyvinyl butyral, ethyl vinyl acetate, or thermoplastic polyurethane, for example.

In yet another example, the window assembly 40 may be in the form of a vacuum insulated window in which the sealed chamber 94 between the first and second panes 90, 92 is vacuum sealed. Providing a vacuum between the first and second panes 90, 92 attenuates sound vibration transmission from the treating chamber 16 by decoupling the first and second panes 90, 92. In an insulated assembly in which air or gas is present in the sealed chamber 94 defined by the first and second panes 90, 92, the air or gas transmits sound vibrations from one pane 90, 92 to the next pane 90, 92. When a vacuum is provided between the first and second panes 90, 92, the vacuum inhibits the transmission of sound waves between the first and second panes 90, 92. Thus, the thickness of the second pane 92 in combination with the decoupling of the first and second panes 90, 92 by the vacuum decreases the sound vibration transmission from within the treating chamber 16 to the exterior of the dishwasher 10. An exemplary insulated window assembly 40 would be in the range of 25 mm thick, while a vacuum insulated window assembly 40 would be in the range of 7 mm thick.

The vacuum insulated window assembly 40 may also include additional spacer elements distributed randomly or in a pattern within the chamber 94 between the first and second panes 90, 92 to prevent the first and second panes 90, 92 from collapsing against one another when the vacuum is generated within the chamber 94. In one example, the spacer elements may be distributed in a pattern to form an image or text.

Figure 7:
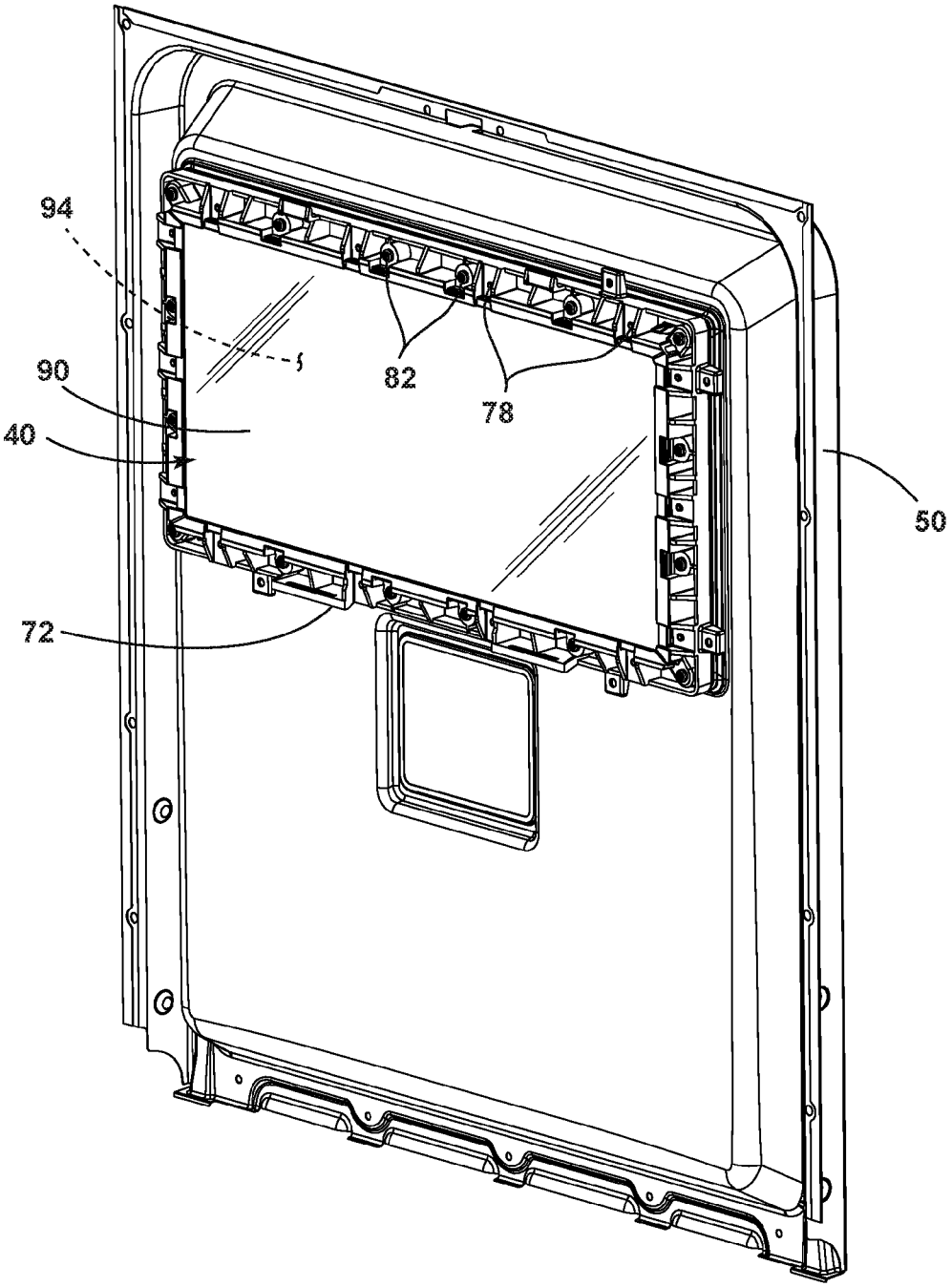
FIG. 7 is a rear perspective view of the assembled door of FIG. 6.
Figure 8:
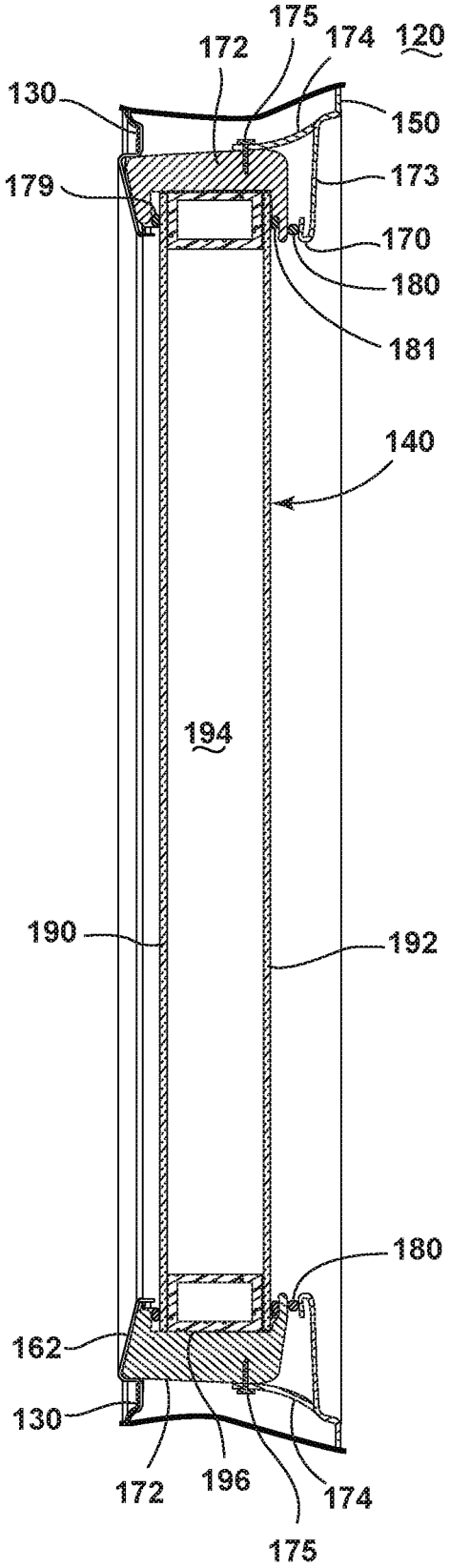
FIG. 8 is a cross-sectional view of a door assembly according to an embodiment of the invention.

FIGS. 7 and 8 illustrate the window assembly 40 mounted to the interior door panel 50 by the window assembly support frame 72. The window assembly support frame 72 is mounted to the interior door panel 50 such that the entire weight of the window assembly 40 is carried by the interior door panel 50 and the window assembly 40 is aligned with the interior window opening 70. Fasteners 98 are inserted through the first set of mounting flange apertures 76 and received in the first set of aligned apertures 78 in the window assembly support frame 72 to mount the window assembly support frame 72 to the interior door panel 50. As may be seen in FIG. 7, the window assembly support frame 72 may be mounted to the interior door panel 50 through a plurality of apertures 78 spaced around the periphery of the window assembly support frame 72 such that the window assembly 40 is carried by the interior door panel 50 alone.

Referring again to FIG. 6, the interior trim bezel 80 is coupled with the interior door panel 50 in alignment with the interior window opening 70 such that the interior trim bezel 80 provides a fluid-tight seal between the window assembly 40 and the interior door panel 50. As illustrated in the embodiment of FIG. 6, the seal 88 provided on the interior trim bezel 80 includes a first portion that seals the interior trim bezel 80 with the second window pane 92 and a second portion that seals the interior trim bezel 80 with the mounting flange 74, thus providing the fluid seal between the interior door panel 50 and the window assembly 40. The interior trim bezel 80 also provides a decorative trim that conceals the mounting flange 74.

Referring now to FIG. 8, a door assembly 120 is illustrated that is similar to the door assembly 20 except for the manner in which the interior door panel 150 is fluidly sealed with the window assembly 140. Therefore, elements of the door assembly 120 similar to the door assembly 20 are labeled with the prefix 100.

The door assembly 120 includes a window assembly support frame 172 that is configured to mount the window assembly 140 to the interior door panel 150 such that the entire weight of the window assembly 140 is carried by the interior door panel 150 in a manner similar to that described above in FIGS. 6 and 7 for the door assembly 20. For example, the interior door panel 150 may include a mounting flange 174 which may be coupled with the window assembly support frame 172 using a mechanical fastener 175, such as a screw or pin. The window assembly support frame 172 is also configured to be fluidly sealed with a flange 173 defining the interior window opening 170 by a seal 180 without the use of a trim bezel. The seal 180 may be a gasket, foam sealant, or silicone, for example. An additional optional seal 181 may be provided between the window assembly support frame 172 and the window assembly 140.

Figure 10:
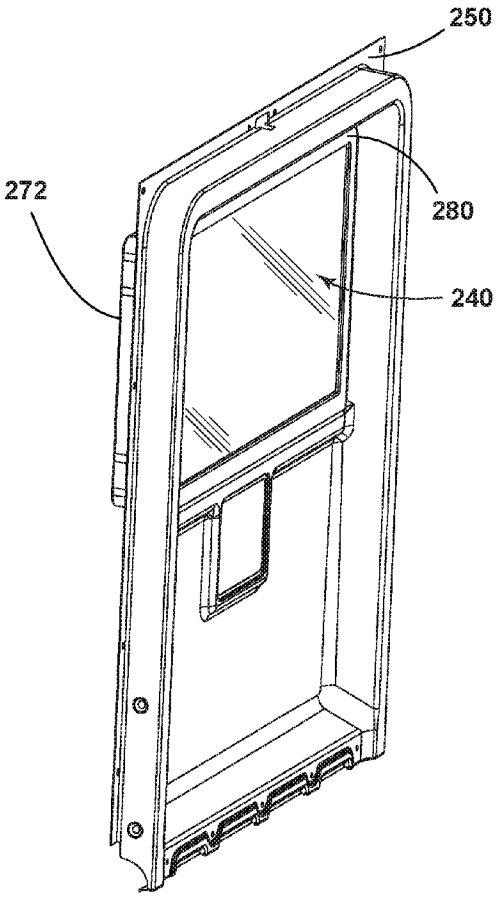
FIG. 10 is a rear perspective view of the door assembly of FIG. 9.
Figure 9:
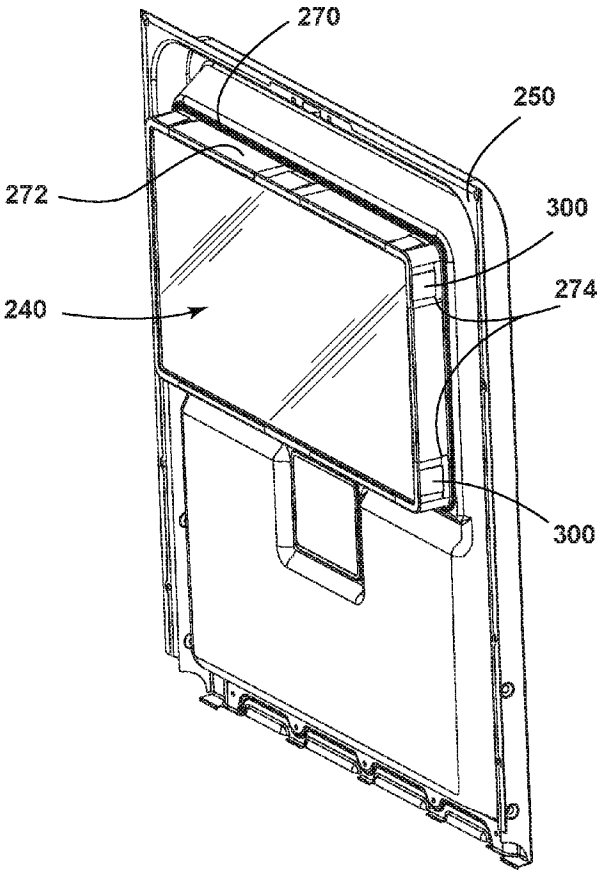
FIG. 9 is a front perspective view of a portion of a door assembly for a dishwasher with an exterior door panel removed according to an embodiment of the invention.
Figure 11:
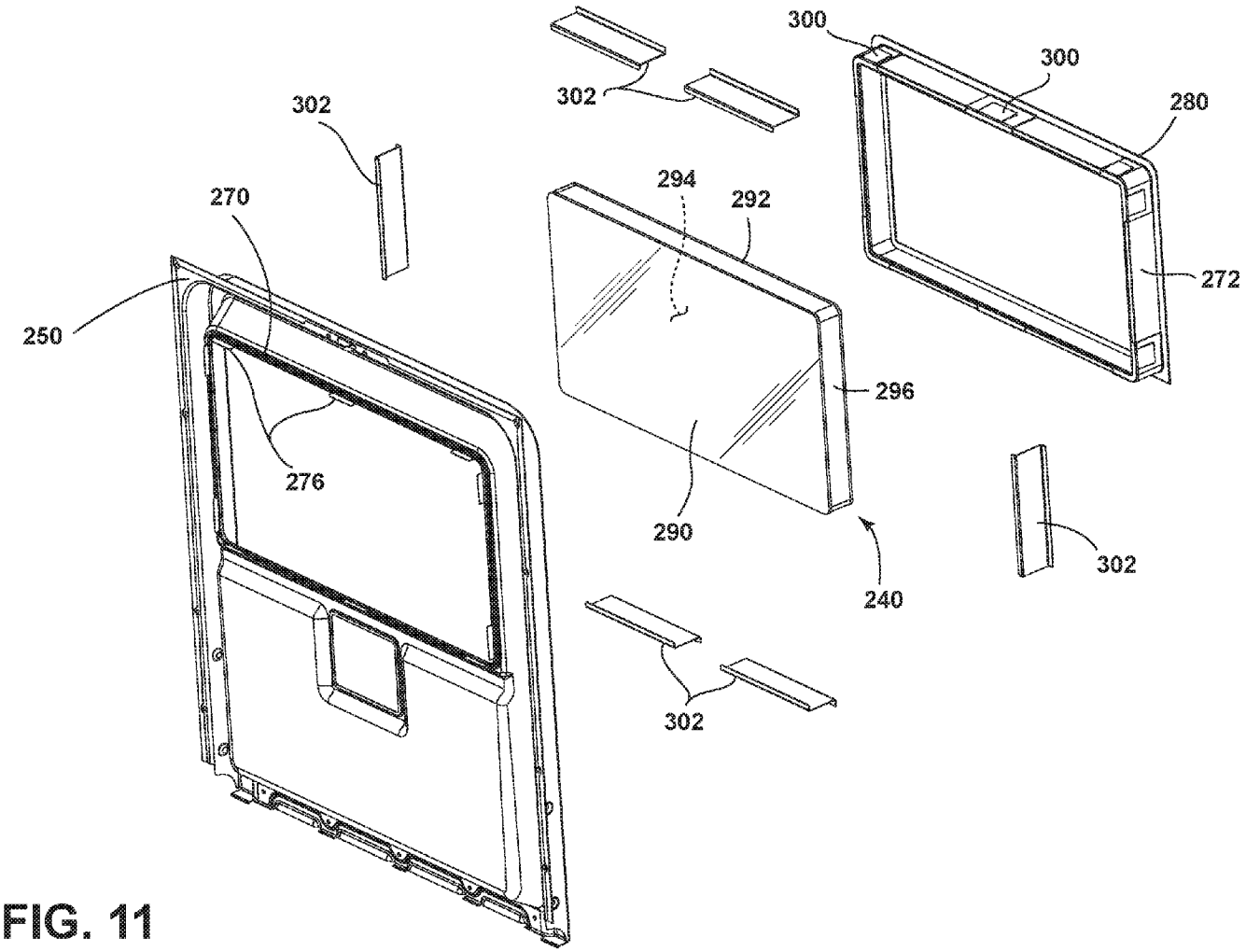
FIG. 11 is an exploded view of the door assembly of FIG. 9.

FIGS. 9-11 illustrate a door assembly 220 similar to the door assembly 20 except for the manner in which the window assembly support frame 272 is mounted to the interior door panel 250. Therefore, elements of the door assembly 220 similar to the door assembly 20 are labeled with the prefix 200.

Referring now to FIGS. 9 and 10, the door assembly 220 includes an interior door panel 250 provided with a window assembly support frame 272 supporting the window assembly 240 such that the entire weight of the window assembly 240 is carried by the interior door panel 250 in a manner similar to that described above for the door assemblies 20 and 120. The interior window opening 270 includes a plurality of flanges 276 which engage aligned detents 300 on the window assembly support frame 272 when the window assembly support frame 272 is received by the interior window opening 270. The flanges 276 may be resilient flanges that flex outward as the window assembly support frame 272 is inserted through the interior window opening 270 and the flanges 276 engage the detents 300 and then return to their un-flexed position to engage the window assembly support frame 272 when the detents 300 pass a terminal edge of the flanges 276.

While the door assembly 220 is described in the context of using resilient flanges and detents to mount the window assembly 240 to the interior door panel 250, it will be understood it is also within the scope of the invention for the window assembly 240 to be mounted to the interior door panel 250 in a manner similar to that described above with respect to the door assembly 20 of FIGS. 5-7 or the door assembly 120 of FIG. 8. It is also within the scope of the invention for the resilient flange and detent mounting structure of the door assembly 220 to be used with the door assembly 20 of FIGS. 5-7 or the door assembly 120 of FIG. 8 to mount the window assemblies 40 and 140 to the respective interior door panel 50 and 150.

As can best be seen in FIG. 11, the window assembly support frame 272 may also include a plurality of structural support elements 302. The structural support elements 302 may be configured to provide additional strength and rigidity to the window assembly support frame 272 to support the window assembly 240 in at least partial alignment with the interior window opening 270 of the interior door panel 250. In one example, the structural support elements 302 may be made from a metal material, such as steel. The structural support elements 302 may be separate elements that are coupled with the window assembly support frame 272 using a weld or adhesive, for example, or integrally formed with the window assembly support frame 272. For example, the structural support elements 302 may be provided within the polymeric material used to form the window assembly support frame 272 such that the structural support element 302 is entirely surrounded by the polymeric material to minimize exposure of the structural support element 302 to moisture. Alternatively, the structural support element 302 may be integrally formed with the window assembly support frame 272 by embedding the structural support element 302 in a surface of the window assembly support frame 272. While the structural support elements 302 are described in the context of the window assembly support frame 272, it is within the scope of the invention for the structural support elements 302 to be used with any of the window assembly support frames 72, 172, 372 and 472 described herein.

Figure 12:
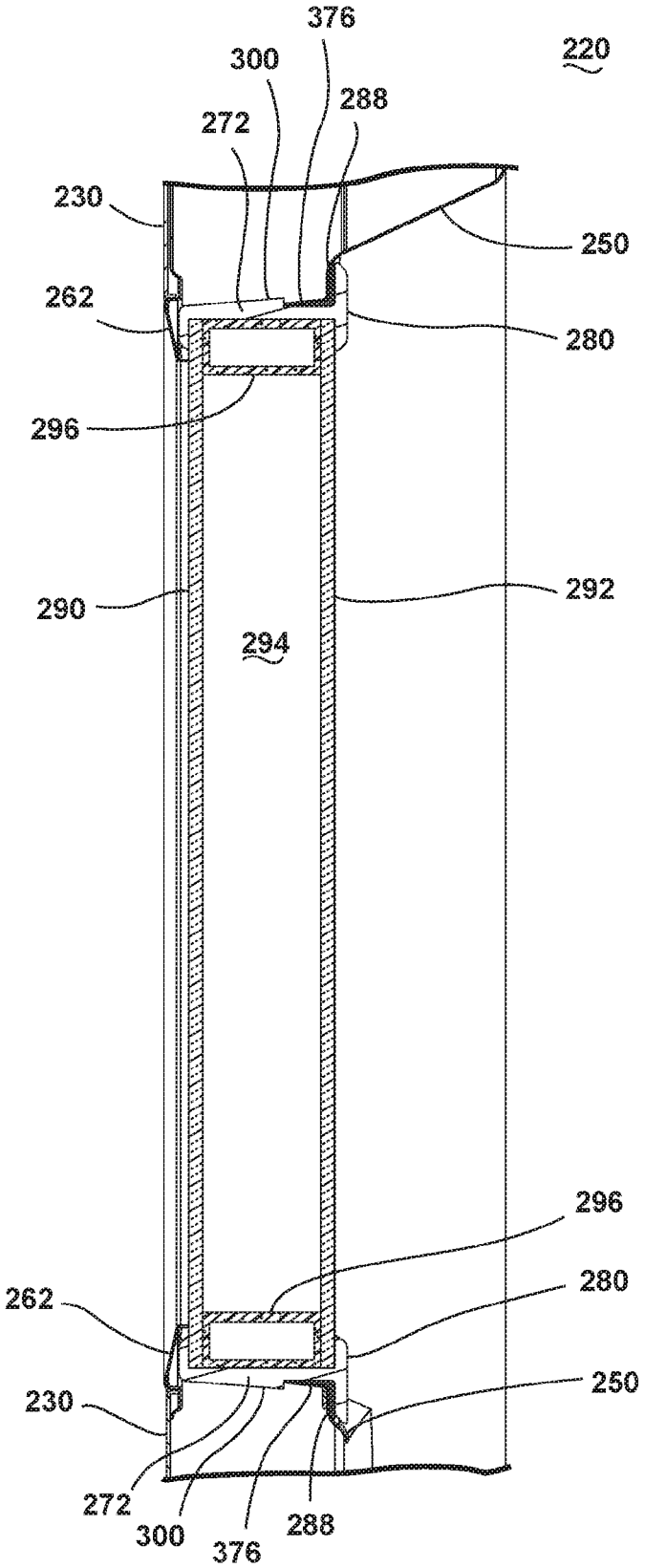
FIG. 12 is a cross-sectional view of a door assembly according to an embodiment of the invention.

Referring now to FIG. 12, the window assembly support frame 272 includes an interior trim bezel 280 integrally formed with the window assembly support frame 272 which fluidly seals the window assembly 240 with the interior door panel 250. An optional seal 288, such as an overmolded gasket, silicone or a foam sealant, may be provided between the interior trim bezel 280 and the interior door panel 250 in an area adjacent the interior window opening 270 and the flanges 276. In one example, the seal 288 may facilitate securing the interior trim bezel 280 to the interior door panel 250. The interior trim bezel 280 may be fluidly sealed with the first and second panels 290, 292 of the window assembly 240 using an adhesive or weld (not shown). The flanges 276 of the interior door panel 250 may optionally be biased towards the interior window opening 270 such that the flanges 276 press against the window assembly support frame 272 to facilitate securing the window assembly support frame 272 within the interior window opening 270. A terminal end 306 of the flanges 276 may also be configured to abut an end face 308 of the detents 300 to further stabilize the window assembly support frame 272 within the interior window opening 270 and inhibit the window assembly 240 from being inadvertently dislodged from the interior window opening 270, such as when the window assembly 240 is pressed against from an exterior side of the door assembly 220. The door assembly 220 may also include an exterior door panel 230 and exterior trim bezel 262 in a manner similar to that described above for the door assembly 20.

Figure 13:
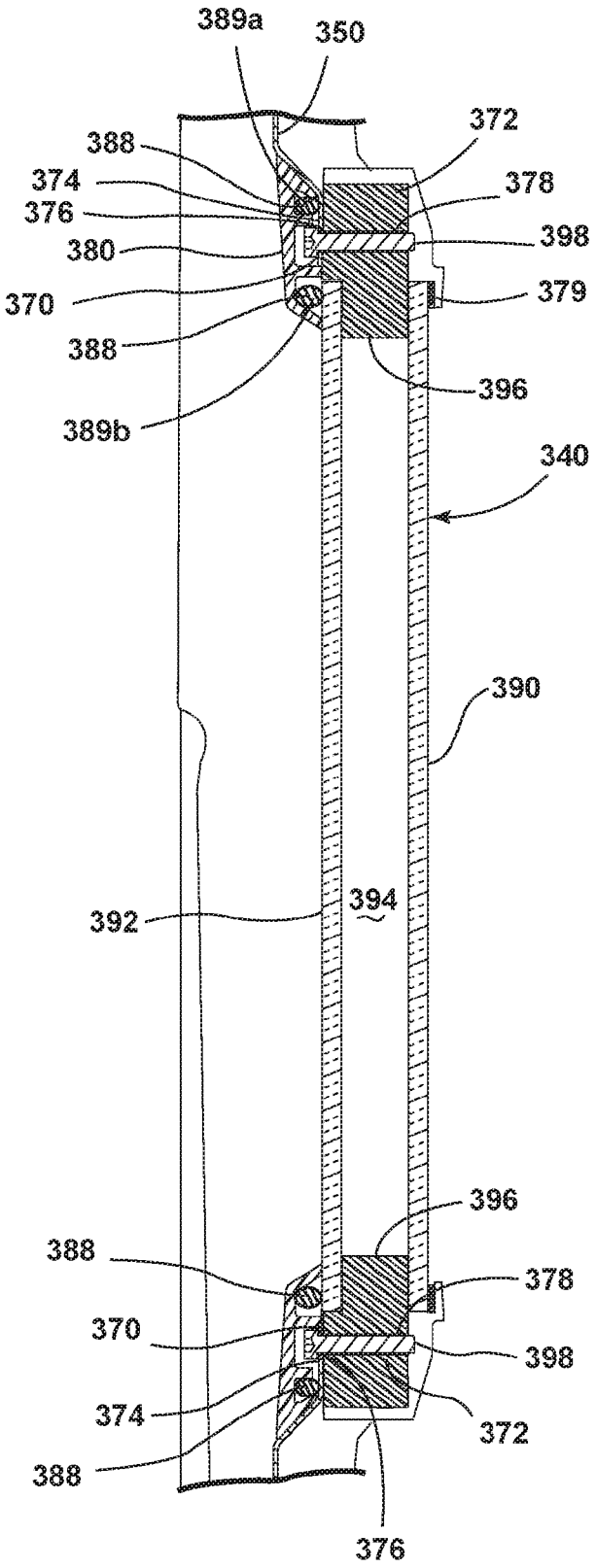
FIG. 13 is a cross-sectional view of a door assembly according to an embodiment of the invention.

FIG. 13 illustrates a door assembly 320 similar to the door assembly 20 except for the configuration of the window assembly support frame 372. Therefore, elements of the door assembly 320 similar to the door assembly 20 are labeled with the prefix 300. In the embodiment illustrated in FIG. 13, the spacer element 396 is integrally formed with the window assembly support frame 372. The spacer elements 96, 196, 296, and 496 of FIGS. 6, 8, 12, and 14, respectively, may also be integrally formed with the respective window assembly support frame 72, 172,272, and 472 in a similar manner. Integrating the spacer element with the window assembly support frame may provide cost and time benefits during manufacturing and assembly of the door panel. The window assembly support frame 372 is mounted to the interior door panel 350 in the same manner as described above with respect to the embodiment of FIGS. 5-7 by fasteners 398 inserted through the interior door panel flange apertures 376 and support frame apertures 378.

Figure 14:
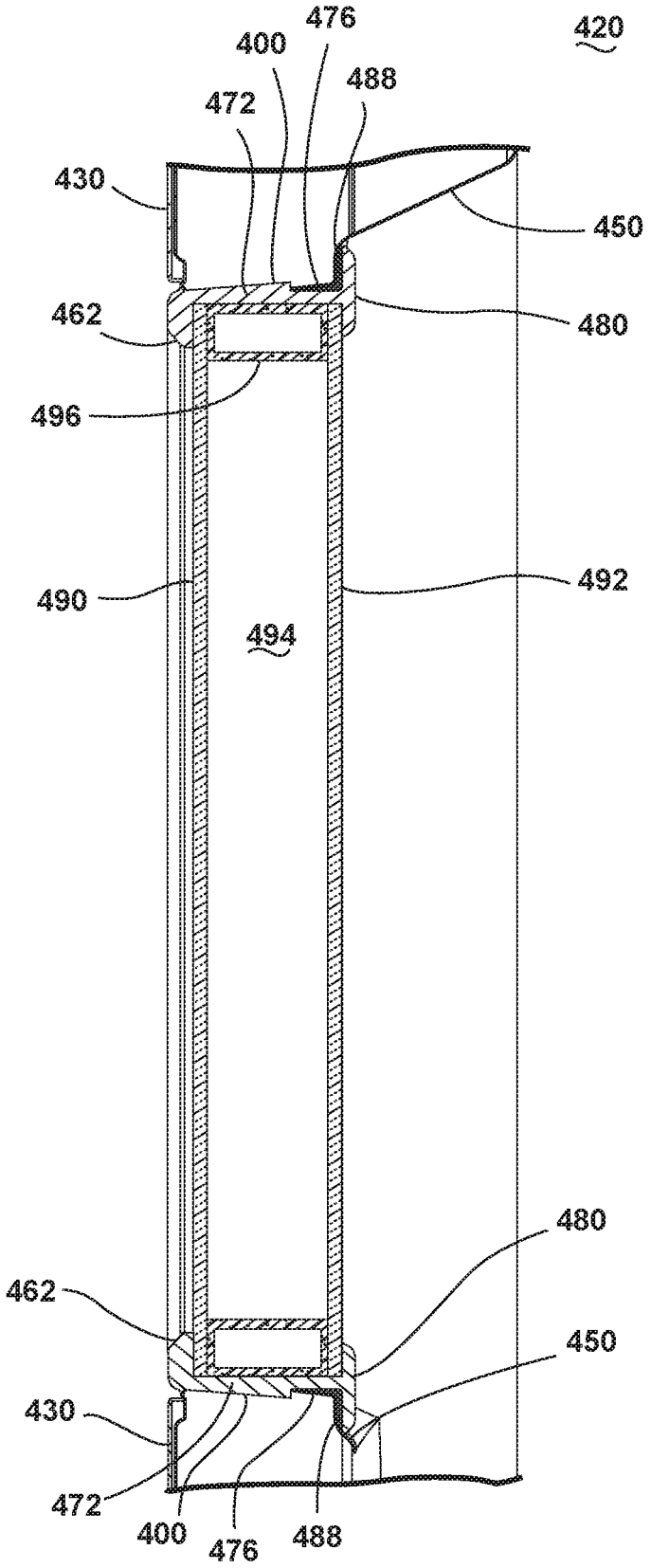
FIG. 14 is a cross-sectional view of a door assembly according to an embodiment of the invention.

FIG. 14 illustrates a door assembly 420 according to another embodiment which is similar to the door assembly 220 except for the manner in which the exterior door panel 430 and window assembly support frame 472 are configured. As illustrated in FIG. 14, the window assembly support frame 472 includes both an interior trim bezel 480 and an exterior trim bezel 462 integrally formed with the window assembly support frame 472. Integrating the window assembly support frame, interior bezel trim and exterior bezel trim into a single component may provide cost and time benefits during manufacturing and assembly of the door panel. The window assembly support frame 472 may be mounted to the interior door panel 450 by the mounting flange 476 and detent 400 structures in the same manner as described above for the interior door panel 220 of FIG. 12.

The door assemblies 20, 120, 220, 320 and 420 described herein include a window assembly formed with first and second panels that define an intervening sealed chamber. In a traditional door assembly in which two separate panels are individually attached, one to the exterior door panel and the other to the interior door panel, humidity and condensation may occur between the panels, which is difficult to prevent. The sealed chamber minimizes the likelihood of moisture entering the spaced between the first and second panels that could obscure the view through the window assembly or build-up over time. Vacuum sealing the intervening sealed chamber may have the additional benefit of decreasing sound transmission from the treating chamber of the dishwasher to the environment exterior of the dishwasher.

The door assemblies 20, 120, 220, 320 and 420 described herein also mount the window assembly to the interior door panel such that the entire weight of the window assembly is carried by the interior door panel. In the embodiments in which a separate interior trim bezel is used, the weight support aspect of the window assembly with respect to the interior door panel is separated from the sealing aspect of the window assembly and interior door panel. For example, in the embodiments illustrated by door assemblies 20 and 320, the weight of the window assembly 40, 340 is transferred to the interior door panel 50, 350 by the window assembly support frame 72, 372 with the fluid seal between the window assembly 40, 340 and interior door panel 50,350 being provided by the interior trim bezel 80, 380. The interior trim bezels 80, 380 also act as a decorative cover for the joint between the window assembly 40, 340 and the interior door panel 50, 350 without supporting the weight of the window assembly 40, 340.

In addition, one or more components of the door assembly, such as the spacer elements, the interior bezel trim and/or the exterior bezel trim may be integrally formed with the window assembly support frame to save on manufacturing and assembly cost and time.

To the extent not already described, the different features and structures of the various embodiments of the invention may be used in combination with each other as desired. For example, one or more of the features illustrated and/or described with respect to one of the door assemblies 20, 120, 220, 320, and 420 may be used with or combined with one or more features illustrated and/or described with respect to the other of the 20, 120, 220, 320, and 420. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A door assembly for a dishwasher comprising a treating chamber for receiving dishes for treatment according to a cycle of operation and a door assembly selectively moveable to close an access opening to the treating chamber, the door assembly comprising:

an interior door panel configured to be disposed adjacent the treating chamber and having a first window opening;

an exterior door panel, spaced from and opposite the interior door panel to define a gap there between and having a second window opening that is at least partially aligned with the first window opening;

a window assembly comprising first and second spaced window panes defining an intervening sealed chamber; and a window assembly support frame provided on the interior door panel and configured to support an entirety of the window assembly such that an entire weight of the window assembly is carried by the interior door panel and such that the window assembly is at least partially aligned with the first window opening and the second window opening;

wherein the window assembly support frame extends as a single piece along an entirety of a depth of the window assembly defined from an exterior face of the first window pane to an exterior face of the second spaced window pane.

2. The door assembly of claim 1 wherein the window assembly support frame is mounted to the interior door panel via a set of mechanical fasteners.

3. The door assembly of claim 1 wherein the window assembly support frame extends along a portion of at least one of the exterior face of the first window pane or the exterior face of the second spaced window pane.

4. The door assembly of claim 1, further comprising a seal and wherein the window assembly support frame is sealed to a portion of the window assembly.

5. The door assembly according to claim 1, further comprising a seal fluidly sealing at least one of the window assembly or window assembly support frame to the interior door panel.

6. The door assembly according to claim 5 wherein the seal comprises a trim bezel providing the sealing function.

7. The door assembly according to claim 6 wherein the seal further comprises at least one of a gasket, a foam sealant, a silicone sealant, or combinations thereof providing the sealing function.

8. The door assembly according to claim 1 wherein the window assembly support frame is coupled with an exterior face of the interior door panel.

9. The door assembly according to claim 1 wherein the window assembly further comprises a seal fluidly sealing the window assembly to the window assembly support frame.

10. The door assembly of claim 1, further comprising at least one of an interior trim bezel or an exterior trim bezel operably coupled to the window assembly support frame.

11. The door assembly according to claim 1, further comprising at least one spacer element between the first and second window panes defining the intervening sealed chamber.

12. The door assembly of claim 11 wherein the at least one spacer element is integrally formed with the window assembly support frame.

13. A dishwasher, comprising:

a treating chamber configured to receive dishes for treatment according to a cycle of operation; and the door assembly according to claim 1 selectively moveable to close an access opening to the treating chamber.

14. A door assembly for a dishwasher comprising a treating chamber for receiving dishes for treatment according to a cycle of operation and a door assembly selectively moveable to close an access opening to the treating chamber, the door assembly comprising:

an interior door panel configured to be disposed adjacent the treating chamber and having a planar section and a flange that at least partially defines a first window opening, the interior door panel having a first side configured to be disposed adjacent the treating chamber and an opposing second side;

an exterior door panel, spaced from and opposite the interior door panel to define a gap there between and having a second window opening that is at least partially aligned with the first window opening;

a window assembly comprising a first window pane and a second window pane spaced from the first window pane and defining an intervening sealed chamber; and a window assembly support frame operably coupled to the flange of the interior door panel and configured to support an entirety of the window assembly such that an entire weight of the window assembly is carried by the interior door panel and such that the window assembly is at least partially aligned with the first and second window openings;

wherein the flange diverges from the planar section and at least partially extends into the gap; and wherein the window assembly support frame is operably coupled to the flange such that the window assembly support frame lies entirely on the first side of the interior door panel.

15. The door assembly of claim 14 wherein the window assembly support frame is mounted to the flange via a set of mechanical fasteners.

16. The door assembly of claim 14, further comprising an interior trim bezel operably coupled to at least one of the window assembly support frame or the flange.

17. The door assembly of claim 14 wherein the window assembly support frame extends along an entirety of a depth of the window assembly defined from an exterior face of the first window pane to an exterior face of the second spaced window pane.

18. The door assembly of claim 17 wherein the window assembly support frame extends along a portion of at least one of the exterior face of the first window pane or the exterior face of the second spaced window pane.

19. The door assembly of claim 14, further comprising a seal and wherein the window assembly support frame is sealed to the flange.

* * * * *